US011837209B2

(12) United States Patent
Rence

(10) Patent No.: US 11,837,209 B2
(45) Date of Patent: Dec. 5, 2023

(54) SOUND-ISOLATING DEVICE FOR PREVENTING A SPOKEN COMMAND-CONTROLLED DEVICE FROM DETECTING SPOKEN WORDS

(71) Applicant: Christopher Joseph Rence, Minnetonka, MN (US)

(72) Inventor: Christopher Joseph Rence, Minnetonka, MN (US)

( * ) Notice: Subject to any disclaimer, the term of this patent is extended or adjusted under 35 U.S.C. 154(b) by 248 days.

(21) Appl. No.: 17/305,689

(22) Filed: Jul. 13, 2021

(65) Prior Publication Data

US 2021/0390939 A1 Dec. 16, 2021

Related U.S. Application Data

(60) Provisional application No. 62/704,533, filed on May 14, 2020.

(51) Int. Cl.
*G10K 11/162* (2006.01)

(52) U.S. Cl.
CPC ..... *G10K 11/162* (2013.01)

(58) Field of Classification Search
CPC .. G10K 11/002; G10K 11/162; H04B 1/3888; H04R 1/025
See application file for complete search history.

(56) References Cited

U.S. PATENT DOCUMENTS

| | | | | |
|---|---|---|---|---|
| 7,080,816 | B1 * | 7/2006 | Vaccaro | F16M 11/18 248/530 |
| 8,189,849 | B2 * | 5/2012 | Waddell | H04R 1/02 381/387 |
| 10,021,228 | B2 * | 7/2018 | Ageishi | H05K 9/0045 |
| 10,038,950 | B2 * | 7/2018 | Avliav | G10K 11/20 |
| 10,128,890 | B2 * | 11/2018 | Thomas | H04M 1/0202 |
| 11,404,038 | B2 * | 8/2022 | Zenk | H04R 1/406 |
| 2014/0161273 | A1 * | 6/2014 | Soufan | G10K 11/1754 381/73.1 |
| 2014/0228081 | A1 * | 8/2014 | Chang | G10K 11/002 455/575.8 |
| 2014/0339012 | A1 * | 11/2014 | Richardson | A45F 5/00 181/202 |
| 2016/0098983 | A1 * | 4/2016 | Lehmann | G10K 11/1787 455/575.1 |
| 2017/0105118 | A1 * | 4/2017 | Lee | H04W 12/02 |
| 2018/0240450 | A1 * | 8/2018 | Moran, Jr. | B65D 25/20 |
| 2018/0277086 | A1 * | 9/2018 | Soffer | G10K 11/175 |
| 2019/0043466 | A1 * | 2/2019 | Masterson | H04R 1/025 |
| 2020/0075035 | A1 * | 3/2020 | Garth, III | H02P 8/22 |
| 2020/0211522 | A1 * | 7/2020 | Gomez | H04R 3/00 |
| 2020/0265825 | A1 * | 8/2020 | Fong | G10L 25/51 |
| 2020/0312291 | A1 * | 10/2020 | Barski | H04R 1/025 |
| 2020/0337186 | A1 * | 10/2020 | Eveleigh | G10K 11/002 |

(Continued)

*Primary Examiner* — Jeremy A Luks
(74) *Attorney, Agent, or Firm* — Dunlap Bennett & Ludwig, PLLC

(57) ABSTRACT

Devices, assemblies, and methods for isolating a spoken command-controlled device from sound are disclosed herein. A sound-isolating device is provided to achieve this end. The sound-isolating device includes a base that supports the spoken command-controlled device and an enclosure that rests on the base and covers the spoken command device, in use. The base and enclosure are formed from sound-attenuating materials and, together, define a substantially sound-isolated volume.

9 Claims, 3 Drawing Sheets

(56) References Cited

U.S. PATENT DOCUMENTS

| | | | | |
|---|---|---|---|---|
| 2020/0342842 | A1* | 10/2020 | Cunningham | G10K 11/162 |
| 2020/0413567 | A1* | 12/2020 | Chusseau | H04R 1/288 |
| 2021/0327432 | A1* | 10/2021 | Schwartz | G10L 21/06 |

* cited by examiner

SOUND-ISOLATING DEVICE FOR PREVENTING A SPOKEN COMMAND-CONTROLLED DEVICE FROM DETECTING SPOKEN WORDS

CROSS-REFERENCE TO RELATED APPLICATION

This application claims the benefit of priority of U.S. provisional application Ser. No. 62/704,533, filed May 14, 2020, the contents of which are herein incorporated by reference.

BACKGROUND OF THE INVENTION

The present invention relates to a device for preventing an electronic device from being able to detect a person's speech and, more particularly, to a physical device for preventing a smart speaker or other artificial intelligence (AI) device from being able to secretly listen into a conversation.

Currently, spoken command-controlled devices (also known as "smart speakers") or other similar AI devices are able eavesdrop on a conversation with always on/listening functionality. This feature, while convenient when the device is used frequently, leads to a complete loss of privacy to a user that otherwise only wants the device to listen when something is needed from it (e.g., asking a question, placing an order, adding an item to a list, etc.). With the always on/listening functionality, every conversation is at risk of being recorded or otherwise listened to the by spoken command-controlled device.

Conventional solutions provide technical ways to disable the device via options integrated direction on the device itself, such as spoken commands or pushing a mute button. However, these solutions require a level of trust with the manufacturer, other technical tools, and/or software to be added to the device. Apart from unplugging it, there is no way to know for certain that the spoken command-controlled device is listening. Even still, that solution may not be enough because many of these aforementioned devices also have backup batteries, meaning that the act of unplugging does not solve the basic problem of the device being able to listen in on everything spoken in its vicinity.

As can be seen, there is a need for a physical device for preventing a smart speaker or other artificial intelligence device from being able to secretly listen into a conversation.

SUMMARY OF THE INVENTION

In one aspect of the present invention, a sound-isolating device for isolating a spoken command-controlled device from sound comprises: a base formed from a first sound-attenuating material and being configured to support the spoken command-controlled device; and an enclosure formed from a second sound-attenuating material and sized to cover the spoken command-controlled device, the enclosure resting on the base to define a substantially sound-isolated volume.

In another aspect of the present invention, an assembly comprises: a spoken command-controlled device; and a sound-isolating device that isolates the spoken command-controlled device from sound, the device comprising: a base formed from a first sound-attenuating material and supporting the spoken command-controlled device; and an enclosure formed from a second sound-attenuating material and sized to cover the spoken command-controlled device, the enclosure resting on the base to define a substantially sound-isolated volume, the spoken command-controlled device being housed within the substantially sound-isolated volume.

In yet another aspect of the present invention, a method for isolating a spoken command-controlled device from sound comprises the steps of: (1) providing a spoken command-controlled device; (2) providing a sound-isolating device that isolates the spoken command-controlled device from the sound, the sound-isolating device comprising: a base formed from a first sound-attenuating material; and an enclosure formed from a second sound-attenuating material and sized to cover the spoken command-controlled device; (3) placing the spoken command-controlled device on the base such that the spoken command-controlled device is supported by the base; and (4) resting the enclosure on the base to define a substantially sound-isolated volume, the spoken command-controlled device being housed within the substantially sound-isolated volume.

These and other features, aspects and advantages of the present invention will become better understood with reference to the following drawings, description and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
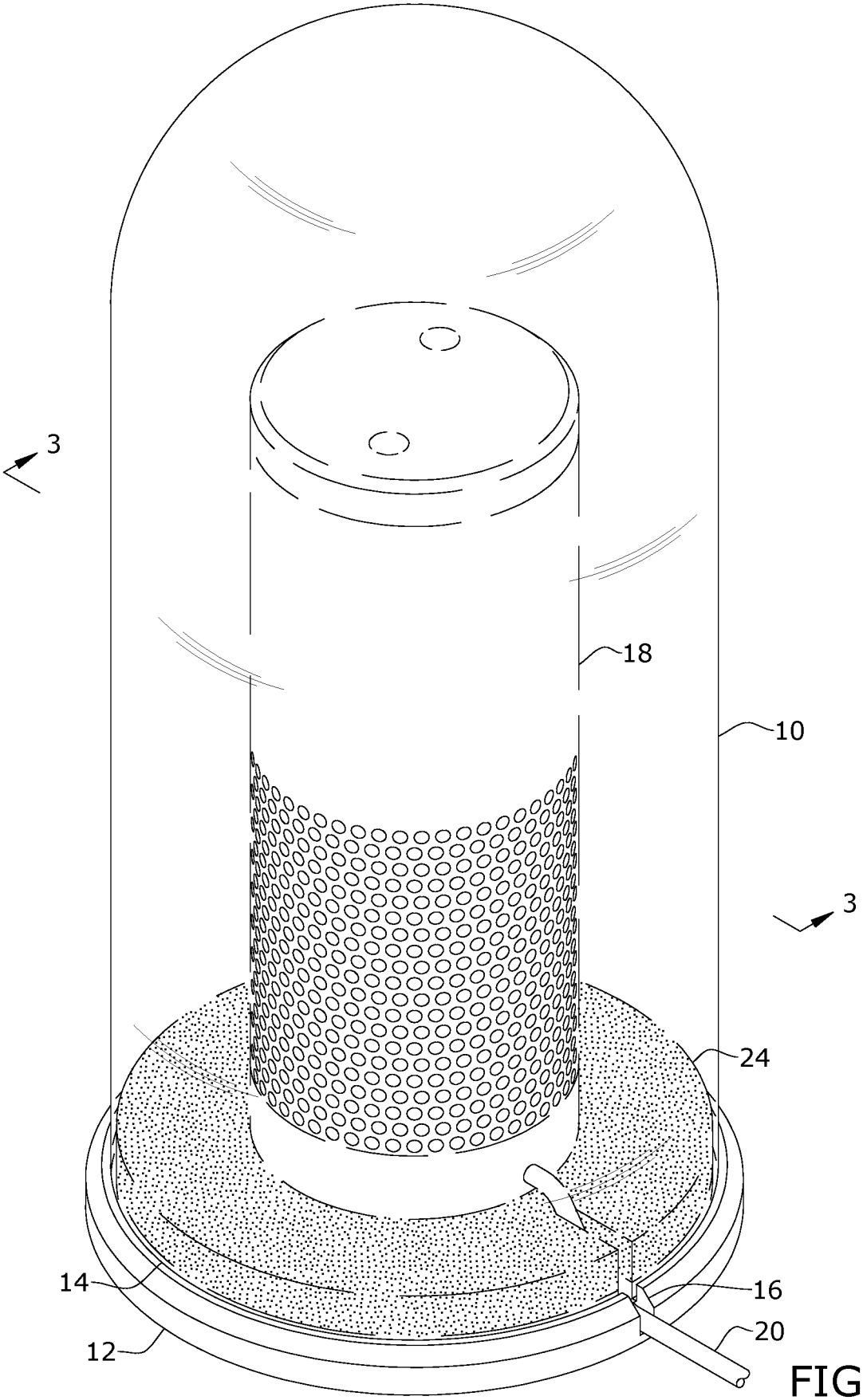
FIG. 1 is a perspective view of an embodiment of the present invention, shown in use with a spoken command-controlled device.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without these specific details.

Broadly, one embodiment of the present invention is a sound-isolating device for isolating a spoken command-controlled device from sound. The device includes (1) a base formed from a first sound-attenuating material and being configured to support the spoken command-controlled device, and further includes (2) an enclosure formed from a second sound-attenuating material and sized to cover the spoken command-controlled device. In use, the enclosure rests on the base to define a substantially sound-isolated volume for the spoken-controlled device to be contained within.

Advantageously, embodiments of the present invention add a layer of air space between a spoken command-controlled device, such as a smart speaker (e.g., AMAZON ECHO™, HOMEPOD™, and GOOGLE HOME™), or other AI devices and an enclosure made from a noise-attenuating material (it will be appreciated that "noise" and "sound" are used synonymously with one another), such as a glass dome. This prevents the AI devices from being able to fully detect words and eliminates its ability to listen to and understand a conversation. In use, the device is set onto a sound-attenuating base, such as a rubber base, of the enclosure and when the sound-attenuating enclosure is placed over the base and secured into the base, the AI device is almost completely isolated from outside sounds and words.

Embodiments of the present invention are simple, quick to implement, effective at blocking noise, and aesthetically pleasing. These embodiments do not require technical knowledge and they eliminate the need to place faith in the manufacturers that the voice command-controlled devices are not always listening to conversations. The devices described herein are manually operated and passively block sound from passing through when covering a smart speaker or other AI device. Besides when being opened and closed to place the voice command-controlled device, the devices are non-mechanical. Consequently, there are many benefits over conventional, more complicated approaches, e.g., the simplicity of the devices, ease of use, and low cost (compared to more technical solutions), to the highly technical problem of an always listening device.

Figure 2:
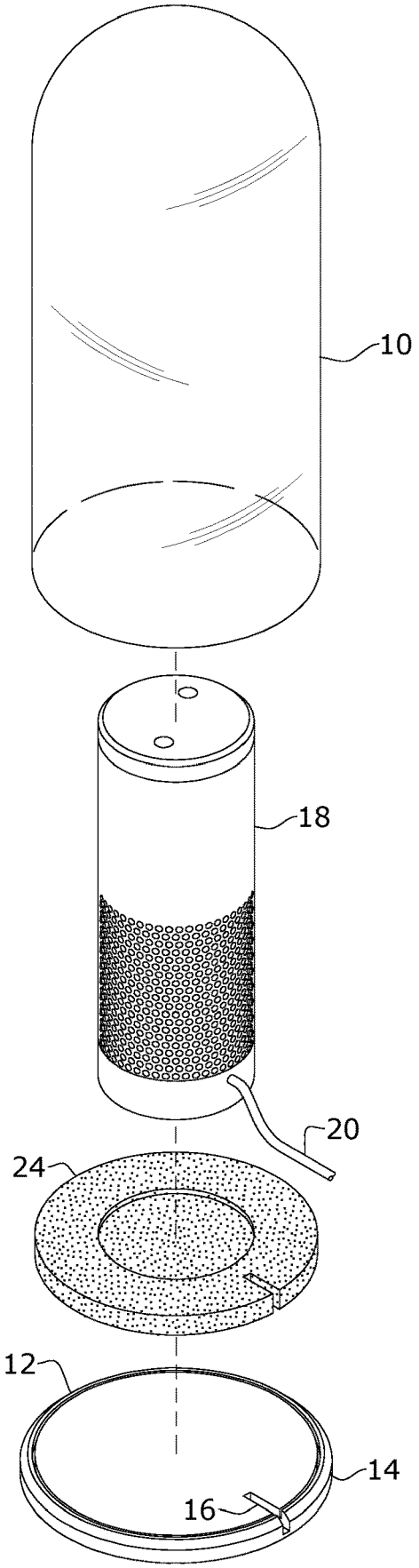
FIG. 2 is an exploded view of the embodiment of the present invention, in use.
Figure 3:
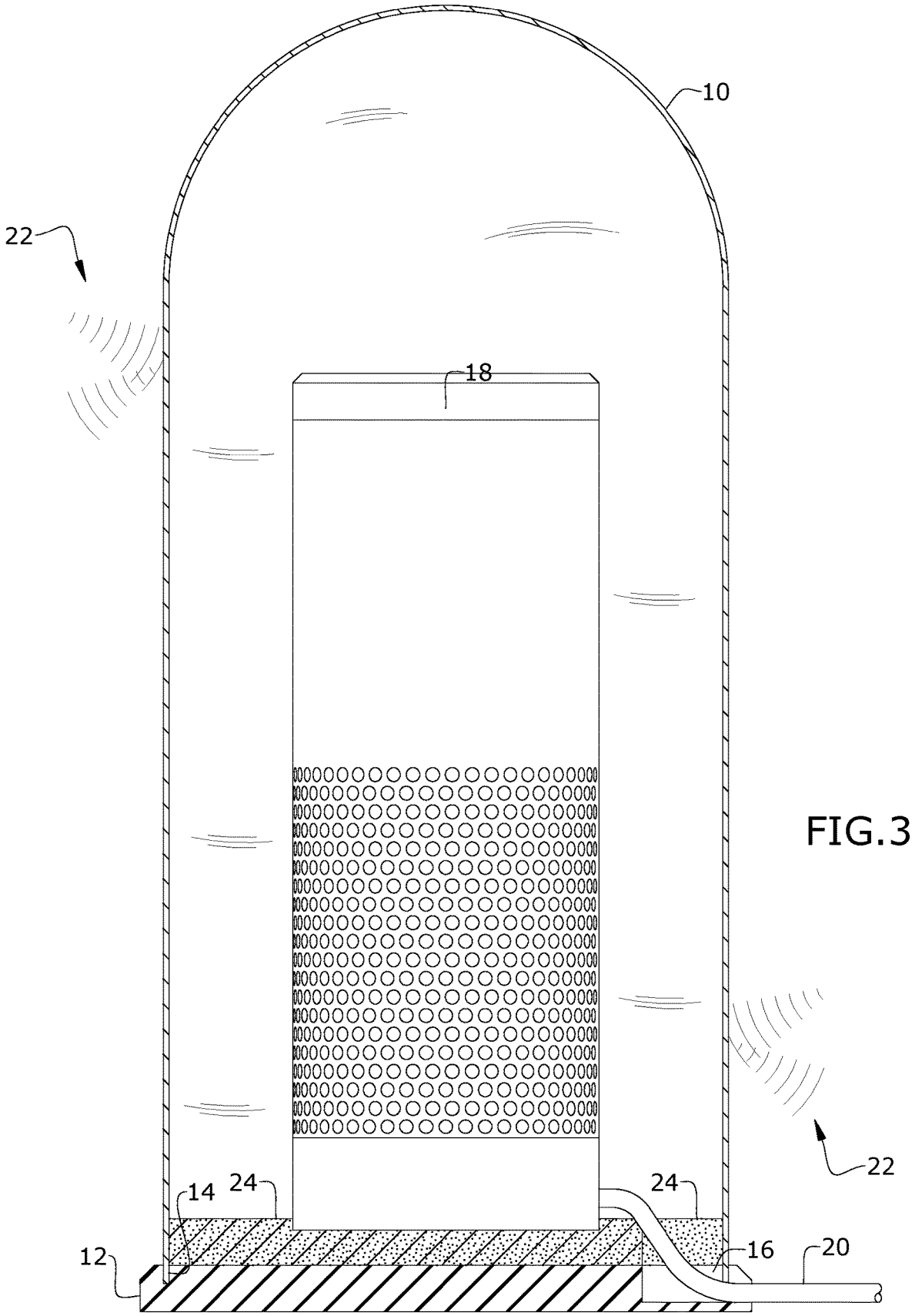
FIG. 3 is a section view taken along line 3-3 from FIG. 1, with the spoken command-controlled device shown in full.

Referring now to FIGS. 1-3, embodiments of the present invention include two primary components, namely, an enclosure 10 supported by a base 12. The enclosure 10 is made from a sound-attenuating material, such as a glass dome (e.g., a glass bell jar). The enclosure 10 is sized to fit around a voice command-controlled device 18, such as a smart speaker or another AI device. The base 12 is also made from a sound-attenuating material, such as rubber. In other embodiments, the enclosure 10 may be formed from other sound-attenuating materials, like plastic, and the base may be formed from other sound-attenuating materials, like wood. However, it has generally been found that glass and rubber provide superior sound reflection and absorption compared to other material combination. The thicknesses/dimensions of all components are selected such that sufficient sound attenuation is achieved, and spoken words are not discernably transmitted through the enclosure 10 and the base 12.

As shown in FIG. 3, in use, a bottom lip of the enclosure 10 rests securely in the base 12 via a dome groove 14. This forms a sound-tight seal therebetween. As shown in FIG. 2, the groove 14 extends proximal a circumferential edge of the base 12. Further, a recess 16 is formed in the base 12 to serve as a pass-through conduit for the voice command-controlled device power cable 20. The recess 16 may be, in certain embodiments, deformable and/or expandable for different size power cords 20 due to the flexible material used to make the base 12. As shown in FIG. 3, the power cord 20 and bottom lip of the enclosure 10 create a snug fit with one another to better maximize noise attenuation.

In accordance with embodiments of the present invention, an additional pad 24, made from materials such as foam or another type of rubber, may be sandwiched between the device 18 and the base 12, as shown in FIGS. 1-3, to provide even further sound attenuation in addition to the enclosure 10 and base 12. The pad 24 may incorporate a recess similar to that of the one in the base 12 such that the power cord 20 may extend therethrough. However, in certain embodiments of the present invention, this pad 24 may be omitted. This assembly (with pad 24), similar to embodiments that do not employ an additional pad 24, creates an air gap that disrupts the sound travel from outside the enclosure 10 to the voice command-controlled device 18. Optionally, the pad 24 and enclosure 10 may be used separately as their own sound attenuating unit, excluding the base 12 from the assembly.

In use, the device 18 is placed on top of the base 12 (or the pad 24 in embodiments where it is used in addition to or alternatively). Next, the enclosure 10 is placed over the device 18 and sealingly engages the base 12. Thus, the enclosure 10 and base 12 create an isolated environment, with an air gap being formed between the enclosure 10 and the device 18. Together, they prevent sound waves 22 from reaching the device 18. Most of the sound waves 22 are reflected away from the device 18. Advantageously, due to the material types selected, and how the components fit together, sound waves 22 that are not reflected away are substantially attenuated, meaning sound is disrupted on its path to the device 18 and the device 18 will not be able to identify what words are being spoken. As a user so desires, the enclosure 10 can simply be lifted off the base 12 to expose the device 18, and the voice command-controlled device 18 can be operated as it was intended (i.e., the user may interact with the device 18).

As is readily seen from the present disclosure, this assembly may be used with a plurality of electronic devices. For example, if a user is concerned that other personal devices, like a cell phone or a personal emergency call device, can listen to a conversation, he or she may place the personal device under the enclosure 10. Due to the material choices and physical design, the present invention will also disrupt sound to those devices.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

While apparatuses and methods are described in terms of "comprising," "containing," or "including" various components or steps, the apparatuses and methods can also "consist essentially of" or "consist of" the various components and steps. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sound-isolating device for isolating a spoken command-controlled device from sound, the device comprising:

a base formed from a first sound-attenuating material and being configured to support the spoken command-controlled device; and an enclosure formed from a second sound-attenuating material and sized to cover the spoken command-controlled device, the enclosure resting on the base to define a substantially sound-isolated volume, wherein the base defines a groove on an upper surface thereof, and the enclosure comprises a lower lip configured to extend into the groove, wherein the base defines a recess formed through said upper surface, wherein the recess extends radially inward from a periphery of the base so as to intersect the groove, and wherein the dimensions of the recess, the lower lip, and the deformability of the first sound-attenuating material are configured to form a snug fit with a power cord of the spoken command-controlled device passing from within the substantially sound-isolated volume to outside the substantially sound-isolated volume, whereby the spoken command-controlled device supported on the base is sonically isolated by placing the lower lip into the groove.

2. The sound-isolating device of claim 1, wherein the first sound-attenuating material is rubber.

3. The sound-isolating device of claim 1, wherein the second sound-attenuating material is glass.

4. The sound-isolating device of claim 1, further comprising a pad disposed on the base, wherein the pad has a pad recess formed through the pad, wherein the pad recess extends radially inward from a periphery of the pad so that the pad recess aligns with the recess of the base.

5. An assembly comprising:

a spoken command-controlled device; and a sound-isolating device that isolates the spoken command-controlled device from sound, the device comprising:

a base formed from a first sound-attenuating material and supporting the spoken command-controlled device; and an enclosure formed from a second sound-attenuating material and sized to cover the spoken command-controlled device, the enclosure resting on the base to define a substantially sound-isolated volume, the spoken command-controlled device being housed within the substantially sound-isolated volume, wherein the base defines a groove on an upper surface thereof, and the enclosure comprises a lower lip configured to extend into the groove, wherein the base defines a recess formed through said upper surface, wherein the recess extends radially inward from a periphery of the base so as to intersect the groove, and wherein the dimensions of the recess, the lower lip, and the deformability of the first sound-attenuating material are configured to form a snug fit with a power cord of the spoken command-controlled device passing from within the substantially sound-isolated volume to outside the substantially sound-isolated volume, whereby the spoken command-controlled device supported on the base is sonically isolated by placing the lower lip into the groove.

6. The assembly of claim 5, wherein the first sound-attenuating material is rubber and wherein the second sound-attenuating material is glass.

7. The assembly of claim 5, further comprising a pad disposed on the base, wherein the pad has a pad recess formed through the pad, wherein the pad recess extends radially inward from a periphery of the pad so that the pad recess aligns with the recess of the base.

8. A method for isolating a spoken command-controlled device from sound, the method comprising:

providing a spoken command-controlled device;

providing a sound-isolating device that isolates the spoken command-controlled device from the sound, the sound-isolating device comprising:

a base formed from a first sound-attenuating material; and an enclosure formed from a second sound-attenuating material and sized to cover the spoken command-controlled device, wherein the base defines a groove on an upper surface thereof, and the enclosure comprises a lower lip configured to extend into the groove, wherein the base defines a recess formed through said upper surface, wherein the recess extends radially inward from a periphery of the base so as to intersect the groove, and wherein the dimensions of the recess, the lower lip, and the deformability of the first sound-attenuating material are configured to form a snug fit with a power cord of the spoken command-controlled device passing from within the substantially sound-isolated volume to outside the substantially sound-isolated volume;

placing the spoken command-controlled device on the base such that the spoken command-controlled device is supported by the base; and placing the lower lip of the enclosure into the groove of the base to define a substantially sound-isolated volume, the spoken command-controlled device being housed within the substantially sound-isolated volume.

9. The method of claim 8, further comprising a pad disposed on the base, wherein the pad has a pad recess formed through the pad, wherein the pad recess extends radially inward from a periphery of the pad so that the pad recess aligns with the recess of the base.

* * * * *